United States Patent [19]

Chiarotto

[11] 3,998,499

[45] Dec. 21, 1976

[54] STEEL BEARINGS WITH POLYCHLOROPRENE AND FLUOROCARBON RESIN

[75] Inventor: Romeo Chiarotto, Padova, Italy

[73] Assignee: Forniture Industriali Padova - S.p.A., Padova, Italy

[22] Filed: Dec. 18, 1975

[21] Appl. No.: 642,112

[52] U.S. Cl. ..... 308/3 R; 267/152

[51] Int. Cl.[2] ..... F16C 29/02

[58] Field of Search ..... 308/3 R, 237 R, 238, 308/241, DIG. 7; 267/152; 14/16

[56] References Cited

UNITED STATES PATENTS

| | | | |
|---|---|---|---|
| 3,397,016 | 8/1968 | Delforce et al. | 308/3 R |
| 3,397,856 | 8/1968 | Sullivan et al. | 308/DIG. 7 |
| 3,520,096 | 7/1970 | Kilcher | 308/3 R X |
| 3,544,176 | 12/1970 | Slater | 308/3 R |
| 3,544,415 | 12/1970 | Price et al. | 308/3 R |
| 3,711,166 | 1/1973 | Wayson | 308/3 R |
| 3,938,852 | 2/1976 | Heiw | 308/3 R |

*Primary Examiner*—M. H. Wood, Jr.
*Assistant Examiner*—Gene A. Church
*Attorney, Agent, or Firm*—Bacon & Thomas

[57] ABSTRACT

A compliant bearing of the fixed or movable type for supporting heavy loads in compression, as advantageously used for coupling piers and scaffolds of a bridge or viaduct, has been developed using multiple layers of polychloroprene and fluorocarbon resin. A steel base plate provided with a recessed seat contains in ascending order: a first sheet of a fluorocarbon resin having a low coefficient of sliding friction, a thick layer of pressed polychloroprene having on its upper part a peripheral seat wherein at least one peripheral weather strip is arranged, and a second sheet of fluorocarbon resin also having a low coefficient of sliding friction, and an upper steel plate located upon the second sheet of fluorocarbon resin. Fixed, unidirectional, and multidirectional horizontal displacement configurations are described.

20 Claims, 3 Drawing Figures

STEEL BEARINGS WITH POLYCHLOROPRENE AND FLUOROCARBON RESIN

BACKGROUND

The present invention relates to an improved bearing for coupling structures such as trusses and columns, or portals and foundations. More particularly, this invention relates to an improved bearing for coupling piers and scaffolds of a bridge or a viaduct.

In modern building construction where large spans are used, such as for example, scaffolding of viaducts or bridges, or roofing of large industrial or public buildings, a problem exists in affording to the structures the capability of unimpeded expansion, contraction and relative movements when subjected to variations in temperature, loading, thermal gradients or similar force-producing conditions.

Various devices are already available which when placed between the upper plane of the piers of a bridge and the related girders, permit the distribution and centering of the dead load of the girders and the overloads thereof at convenient points of the piers, as well as to permit the aforementioned relative movements.

SUMMARY

The subject invention describes a bearing which embodies all of the abovementioned characteristics and performance requirements, which enables a simple and precise installation, and absorbs slowly occurring limited deviations in the condition of parallelism between a lower structure, for example a pier, and an upper structure, for example, a bridge girder. The bearing reacts to both positive and negative vertical forces by virtue of its unique construction which permits oscillations about any horizontal axis while maintaining the load substantially in the axis of the center of gravity, and which further, permits movements in determined, pre-established directions.

The bearing according to the instant invention comprises a base plate made of steel provided with a seat containing, in successive layers, a first thin sheet of fluorocarbon resin having a very low coefficient of sliding friction, a thick disc of pressed polychloroprene having on its upper part a peripheral seat wherein at least one peripheral weather strip is arranged, and a second sheet of fluorocarbon resin also having a very low coefficient of sliding friction. An upper plate made of steel is located atop the second sheet of fluorocarbon resin thereby substantially completing the assembly.

The first and second sheets of fluorocarbon resin having a very low coefficient of sliding friction are preferably made of polytetrafluoroethylene (PTFE).

According to a preferred embodiment, the bearing is realized as a fixed bearing. The upper plate of the fixed bearing is directly in contact with the second sheet of PTFE. Preferably, the seat provided in the base plate is cylindrically shaped and the upper plate is provided with a substantially cylindrical lower part which is introduced directly into the cylindrical seat and rests upon the second sheet of PTFE.

According to another preferred embodiment, the bearing is constructed as a unidirectional or multidirectional bearing which permits the lengthening or the shortening of the upper structure laying on the bearing respectively in a predetermined direction or in any direction. The uni- or multidirectional bearings further comprise an intermediate element between the upper plate and the second sheet of fluorocarbon resin, on which the upper plate rides. Preferably, the seat provided in the base plate is cylindrically shaped, and the intermediate element comprises a substantially cylindrical lower part which is introduced directly into the cylindrical seat and rests upon the second sheet of PTFE. The upper plate presents a sliding surface of low sliding coefficient with regard to the intermediate element.

Dust shielding devices or scrapers may be provided between the upper plate and base plate of the bearing according to the invention for impending the entry of foreign matter.

An eyebolt connection and blocking plates or screws may also be provided for connecting the upper plate and the base plate during transportation or laying.

BRIEF DESCRIPTION OF THE DRAWINGS

The invention will be further understood with reference to the following description, reference being made to the accompanying drawings wherein.

DETAILED DESCRIPTION

Figure 1:
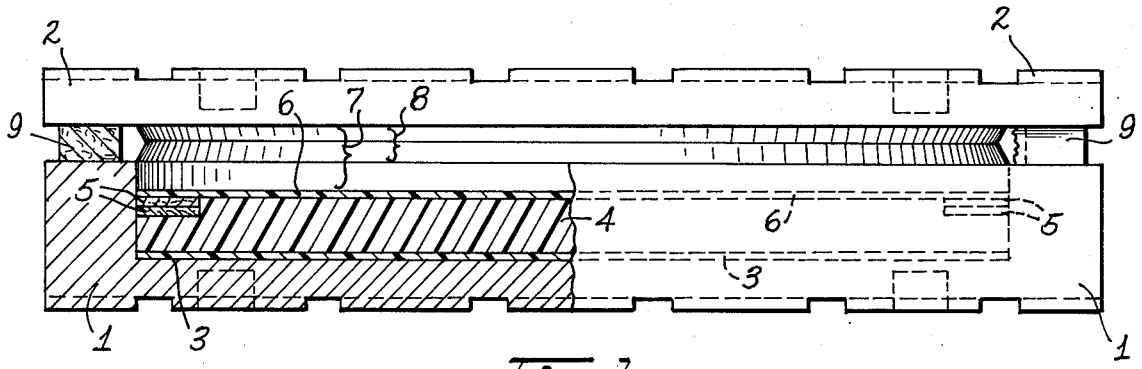
FIG. 1 is a side elevational view, partially in section of a fixed bearing according to the invention.

Referring to FIG. 1, a fixed bearing is illustrated which will react to vertical forces from top to bottom, and to all forces lying in the horizontal plane, and which will also permit small rotations about a horizontal axis. The bearing has a baseplate 1 in the shape of a parallelepiped, and an upper plate 2, hereafter designated a cover, having the same overall outer shape of the base plate 1. The base plate 1 is made of rolled, forged or cast steel and is provided with a cylindrical seat suitable to accomodate in ascending order: a first thin circular sheet 3 of fluorocarbon resin, which possesses a very low coefficient of sliding friction; a thick disc 4 of pressed polychloroprene, which disc is provided with a crowned circular seat into which are introduced two weather strips 5; a second thin circular sheet 6 also of fluorocarbon resin; and a lower substantially cylindrical part 7 extending downwardly from the cover 2. The lower substantially cylindrical part 7 comprises two superimposed thin plate sections of a sphere 8, and is made of rolled, forged or cast steel integrally with the cover 1. The lower substantially cylindrical part 7 is only partially introduced into the upper part of the cylindrical seat of the plate 1. Dust shielding devices 9 are provided for impeding the entry of foreign matter during laying and operation of the bearing. An eyebolt connection (not shown) and blocking plates or screws (not shown) are provided for transporting and laying the bearing.

Numerous experimental results have confirmed the theoretical hypotheses that the base plate must be necessarily dimensioned as a receptable subject to the pressure exerted by the polychloroprene, and the contact pressures with concrete must be obtained by means of the rigorous theory of plates resting on an elastically yielding floor.

Figure 2:
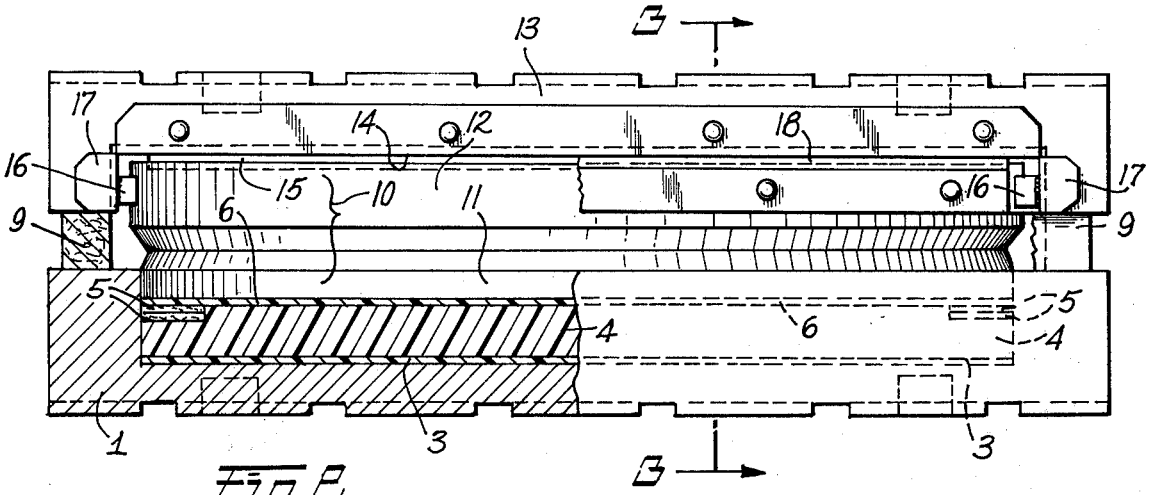
FIG. 2 is a side elevational view of a unidirectional bearing according to the invention.
Figure 3:
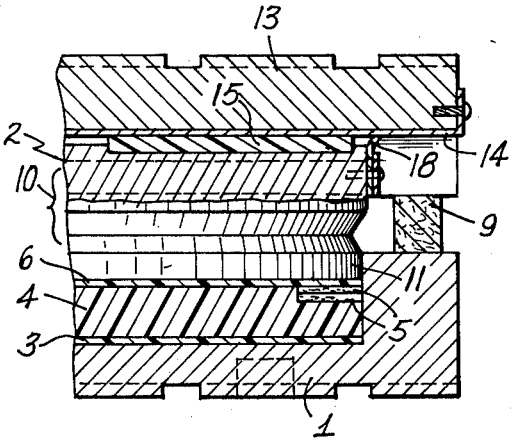
FIG. 3 is a fragmentary vertical sectional view taken along the line 3—3 of FIG. 2.

Referring to FIG. 2, the unidirectional bearing is identical to the above described fixed bearing with respect to the baseplate 1 and to the thin circular sheets 3 and 6, thick disc 4 and weather strips 5 located therein. It additionally comprises a plate or an intermediate element 10 having a substantially cylindrical lower portion or part 11 seated inside the opening of the baseplate 1. An upper part 12 of this intermediate element 10 is in the shape of a thin parallelepiped having a square base. The upper part 12 is seated inside special prismatic guides provided in an upper monolithic plate or slide 13 of the unidirectional bearing.

The multidirectional bearing according to the invention is identical to the above described unidirectional bearing except that the intermediate element 10 is completely cylindrical and the slide 13 of any polygonal form, in particular rectangular, is without guides.

To minimize the sliding friction between the slide 13 and the intermediate element 10, the lower surface of the slide 13 is covered with a sheet 14 of mirror-polished stainless steel, while the upper part 12 of the intermediate plate 10 is covered either partially or completely by a plurality of elements 15 of PTFE of suitable form, such as for example, strips, full discs, or a circular crown. The elements 15 of PTFE are recessed within the upper part 12 to the half of their thickness. The lateral sides of the upper part 12 are also provided with a covering 16 in PTFE which is in contact with a stainless steel covering 17 positioned on the corresponding surfaces of the intermediate element 10.

The sliding surfaces are protected from every possible form of damage and fouling by means of dust shields and scrapers 9.

Complementary accessories such as an eyebolt connection (not shown), a supplementary dust shield 18, and blocking plates (not shown) identical to those mentioned for the fixed bearing, are provided for transporting and laying these uni- or multidirectional bearings.

In the most basic static operating scheme, a fixed bearing and a movable, unidirectional bearing, the upper plate of which movable bearing is orientated along the axis of the two bearings, are respectively placed at the two extremities of a girder.

The vertical loads and rotations of the ends of the girder are absorbed by the two polychloroprene discs located in the seats of the two base plates, while the horizontal thrusts are absorbed by the particular arrangements of the combination of all the elements which constitute the fixed and movable bearings.

Lengthening and shortening of the girder are permitted in the predetermined direction by the unidirectional bearing owing to the upper plate which is provided with lateral edges and which travels with the girder on which it is fixed, while the lower plate and intermediate element remain solid with the pier or abutment on which they are located. The low coefficient of sliding friction between PTFE and stainless steel covering, favors the aforementioned relative motion.

More complex static schemes such as hyperstatic structures, box scaffolds, etc., require the use of a greater number of bearings which must be of the multidirectional type.

Although the invention has been described in terms of selected preferred embodiments, the invention should not be deemed limited thereto, since other embodiments and modifications will readily occur to one skilled in the art. It is therefore to be understood that the appended claims are intended to cover all such modifications and changes as fall within the true spirit and scope of the invention.

I claim:

1. A bearing assembly comprising:
   a. a base plate having a recessed seat therein,
   b. a first sheet of fluorocarbon resin, having a low coefficient of sliding friction, positioned directly upon said base plate within said seat,
   c. a layer of pressed polychloroprene lying directly upon said first fluorocarbon resin sheet and positioned within said seat,
   d. a second sheet of fluorocarbon resin, having a low coefficient of sliding friction, in direct contact with the top surface of said layer and positioned within said sheet, and
   e. a plate element having a lower portion extending within said seat, said lower portion positioned on said second sheet.

2. A bearing assembly as recited in claim 1 wherein said plate element has an upper portion forming a cover for the assembly, said upper portion integral with said lower portion, and extending horizontally beyond said seat over said base plate.

3. A bearing assembly as recited in claim 2 wherein said first and second sheets of fluorocarbon resin comprise polytetrafluoroethylene (PTFE).

4. A bearing assembly as recited in claim 3 wherein said plate element and said base plate comprise steel.

5. A bearing assembly as recited in claim 1, wherein the seat provided in said base plate is cylindrically shaped and said lower portion is cylindrically shaped whereby oscillations in any direction are absorbed as well as horizontal bearing thrusts.

6. A bearing assembly as recited in claim 5, further comprising dustshielding means between said plate element and said base plate for impeding the entry of foreign matter, and said layer of pressed polychloroprene having on its upper surface a peripheral seat wherein at least one peripheral weather strip is positioned.

7. A bearing assembly as recited in claim 1, further comprising a cover plate extending horizontally beyond said seat of said base plate, said plate element forming an intermediate element between said cover plate and said second sheet, said cover plate slidable on said intermediate element.

8. A bearing assembly as recited in claim 7, wherein the seat provided in said base plate is cylindrically shaped, the cover plate is further provided with lateral guide edges for presenting a sliding surface, said cover plate slidable along said guide edges relative to said intermediate element, and said intermediate element comprises: a) a substantially cylindrical lower portion extending within said seat and positioned on said second sheet, and b) an upper portion in contact with the guides of said cover plate, the sliding frictional coefficient of said cover plate is low with respect to the sliding frictional coefficient of the intermediate element whereby oscillations are absorbed in any direction, and translational movement occurs in a substantially horizontal plane along the direction of said guide edges.

9. A bearing assembly as recited in claim 8 wherein said first and second sheets of fluorocarbon resin comprise polytetrafluoroethylene (PTFE).

10. A bearing assembly as recited in claim 9 wherein said intermediate element and said base plate comprise steel.

11. A bearing assembly as recited in claim 10 further comprising dust shielding means between said cover plate and said base plate for impeding the entry of foreign matter, and said layer of pressed polychloroprene having on its upper surface a peripheral seat wherein at least one peripheral weather strip is positioned.

12. A bearing assembly as recited in claim 8 wherein at least one PTFE element is disposed between said intermediate element and said cover plate and said cover plate has a lower surface in contact with said at least one PTFE element, said lower surface being of polished stainless steel.

13. A bearing assembly as recited in claim 12 wherein at least one PTFE element is disposed between a side portion of said intermediate element and said cover plate exterior of said seat.

14. A bearing assembly as recited in claim 7 wherein said first and second sheets of fluorocarbon resin comprise polytetrafluoroethylene (PTFE).

15. A bearing assembly as recited in claim 14 wherein said intermediate element and said base plate comprise steel.

16. A bearing assembly as recited in claim 7 wherein at least one PTFE element is disposed between said intermediate element and said cover plate and said cover plate has a lower surface in contact with said at least one PTFE element, said lower surface being of polished stainless steel.

17. A bearing assembly as recited in claim 7, wherein the seat provided in said base plate is cylindrically shaped, said cover plate is slidable in any horizontal direction relative to said intermediate element, and said intermediate element comprises: a) a substantially cylindrical lower portion extending within said seat and positioned on said second sheet, and b) an upper portion in contact with the lower surface of said cover plate, the sliding frictional coefficient of said cover plate is low with respect to the sliding frictional coefficient of the intermediate element whereby oscillations are absorbed in any direction, and multidirectional translational movement occurs in a substantially horizontal plane.

18. A bearing assembly as recited in claim 17 wherein said first and second sheets of fluorocarbon resin comprise polytetrafluoroethylene (PTFE).

19. A bearing assembly as recited in claim 17 wherein said intermediate element and said base plate comprise steel.

20. A bearing assembly as recited in claim 17 wherein at least one PTFE element is disposed between said intermediate element and said cover plate and said cover plate has a lower surface in contact with said at least one PTFE element, said lower surface being of polished stainless steel.

* * * * *